United States Patent [19]

Warwick et al.

[11] 4,269,439

[45] May 26, 1981

[54] DOOR HOLDBACK DEVICE

[75] Inventors: James M. Warwick, Whittier; David C. Liu, Walnut, both of Calif.

[73] Assignee: Utility Trailer Manufacturing Company, Industry, Calif.

[21] Appl. No.: 61,921

[22] Filed: Jul. 30, 1979

[51] Int. Cl.[3] ..... E05C 19/10

[52] U.S. Cl. ..... 292/246

[58] Field of Search ..... 292/246, 247, DIG. 16, 292/DIG. 19, 218

[56] References Cited

U.S. PATENT DOCUMENTS

| | | | |
|---|---|---|---|
| 994,427 | 6/1911 | Ross | 292/246 X |
| 1,181,311 | 5/1916 | Huber | 292/246 |
| 3,716,260 | 2/1973 | Herlein | 292/DIG. 19 X |
| 4,127,292 | 11/1978 | Mader | 292/246 |

*Primary Examiner*—Richard E. Moore

*Attorney, Agent, or Firm*—Lyon & Lyon

[57] ABSTRACT

A door holdback device holds a door or panel in open position. It may be mounted upon the wall of a conventional boxlike highway trailer and is automatically retractable to an inoperative position. The holdback device has a primary wire loop extending from the wall, said primary loop being integrally attached to two secondary wire loops, which are then secured to the interior of the wall. The secondary wire loops are internally stressed to retract the primary loop when not in use. A second embodiment employs an internally stressed primary loop which moves about its supporting mount to assume an operative position.

11 Claims, 10 Drawing Figures

DOOR HOLDBACK DEVICE

BACKGROUND OF THE INVENTION

This invention relates to a door holdback device for holding a door in open position. The device may be used for holding open a swinging door or panel of the type mounted on a boxlike highway trailer. The holdback device automatically retracts to an inoperative recessed position having a low profile and minimum projection, when not in use.

Highway trailers of conventional design have hinged doors at various positions along the external walls. These doors are normally found in either a paired arrangement at the rear of the trailer or in a single or paired arrangement along the sidewalls. Doors of this nature swing about vertical axes and have handles or locking rods extending therefrom. It is necessary at times of loading and unloading that these doors be secured in an open position to the sidewalls of the trailer. In addition, vent doors or panels are provided along the sidewalls to facilitate the circulation of air throughout the interior of the trailer. These doors or panels normally pivot about horizontal axes with handles medialy disposed thereon. However, vertically hinged vent doors are also used. During transit, these vent doors are designed to remain open thus facilitating the circulation of air.

Prior attempts to provide operative door holdback devices are manifested in mechanical brackets or clamping structures which extend from trailer sidewalls. These holding devices are of a fixed configuration, each device being adapted to engage only certain types of door handles. Other prior attempts consist of latch devices which must be engaged with a receptacle mounted upon the door.

It is to be noted that trailers of this type are subject to congested conditions while in freight yards thus increasing the possibility that protruding holding devices would be damaged. Furthermore, while these trailers are on the road they are subject to rough terrain thereby causing vibration to act upon the holding devices securing the open vent doors often resulting in failure.

SUMMARY OF THE INVENTION

It is therefore an important object of the present invention to provide a retractable holdback device which is adapted to provide a low profile when in an inoperative position. In this manner the working elements of the holdback device are protected from adverse environmental conditions. It is another advantageous feature of the present invention to provide a door holdback device which is utilizable in either a horizontal or vertical position depending upon the type of door handle with which it will engage.

Additionally, it is another object of the present invention to provide a door holdback device which is able to perform a desired function irrespective of the various size and configured handles and door locking mechanisms with which it must engage.

It is yet a further object of the present invention to provide a door holdback device able to withstand shocks caused by passage of the trailer over rough terrain yet maintain a clasping engagement with a door handle or locking mechanism.

It is a further object of the present invention to provide a door holdback device which is variable in size yet preformed in a manner which facilitates expedient retraction to an inoperative state.

It is a further object of the present invention to provide a door holdback device with a looped cable wherein the cable ends are mounted at an angle to a holding loop thus drastically reducing the possibility of structural failure.

The solution to the problem of providing a retractible door holdback device useful with both current door handles and future configurations utilizes a bracket with a pair of apertures therein. The bracket is mounted upon an apertured sidewall wherein the bracket apertures are coaxial with the sidewall apertures. A cable is passed through both sets of apertures forming a primary loop which extends from the sidewall of the trailer. The primary loop is preformed such that the cable is substantially perpendicular to the plane of the sidewall as it passes through the opposing apertures. The preformed primary loop is adapted to engage a hooked rod found extending from the lower portion of the trailer door or a handle attached to the trailer door.

On the opposite side of the bracket from the primary loop the cable sections extending through the apertures are attached to the bracket in a plane substantially parallel to the plane of the bracket. In this manner two secondary loops are formed on the opposite side of the bracket from the primary loop. It is to be noted that the bracket may be mounted in either a horizontal or a vertical manner depending upon the desired disposition of the primary loop, without affecting the function of the secondary loops. The inherent flexibility provided by a cable permits the primary loop to be twisted in a manner so as to engage handles or rods mounted upon doors in various positions. By forming multiple secondary loops the possibility that the cable will be pulled from its clamping engagement with the bracket is substantially reduced. Furthermore, by providing stop members along the cable lengths which form the secondary loops the stress upon the cable is substantially reduced.

In a second embodiment, the primary loop is mounted upon a bracket in a manner which imparts an internal twisting stress. This stress causes the primary loop to rotate into an inoperative position when not in use.

Other advantageous and objects of the present invention become apparent in the following detailed description and accompanying drawings.

DESCRIPTION OF THE PREFERRED EMBODIMENT

Figure 1:
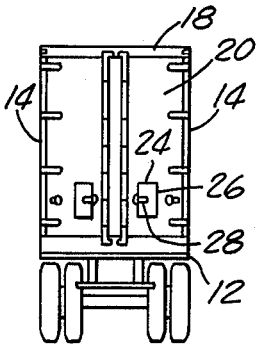
FIG. 1 is a rear view of a conventional boxlike highway trailer.
Figure 2:
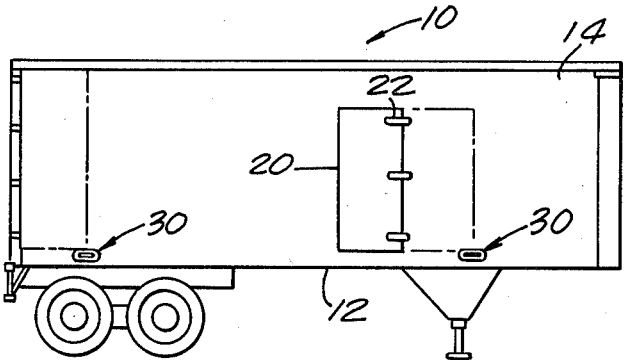
FIG. 2 is a side view thereof.
Figure 3:
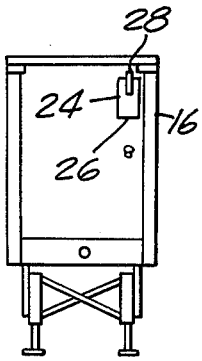
FIG. 3 is a front view thereof.

Referring now to the drawings, and in particular FIGS. 1, 2, and 3, a boxlike conventional trailer 10 having a bottom wall 12 and a top wall 13 has opposing sidewalls 14 with a front wall 16 and a rear wall 18 extending therebetween. Doors 20 located upon either sidewall 14 or the rear wall 18 are connected thereto via hinges 22 which permit 180° movement or more. Within the front wall 16 or within the doors 20 are located vent doors or panels 24 pivotable about an axis 26 and having handles 28 medialy disposed thereon. The vent doors 24 remain open during transit thereby facilitating air movement through the trailer 10. The doors 20 are to remain in a closed position when the trailer 10 is in transit, and to remain open at times of unloading and loading. The doors 20 are locked into a closed position by passing rods 23 through the top wall 13 and the bottom wall 12 as shown in FIG. 1, said rods 23 being moutned on the door 20 by conventional hardware 21.

In accordance with this invention, a door holdback device 30 is disposed along the sidewalls of a conventional trailer 10. The door holdback device 30 as shown in FIGS. 4 to 7, consists of a first bracket 32 juxtaposed next to the sidewall 14, said first bracket 32 having cylindrical posts 34 extending therefrom with apertures 36 located therein. A center aperture 38 is found within the centermost portion of the first bracket 32. The first bracket 32 is substantially coplanar with the sidewall 14 in which a slot 40 is located, said slot 40 having opposing lateral sections 42 and a substantially circular center section 44. The lateral sections 42 are of a diameter which permits the posts 34 to pass therethrough when the center section 44 is in coaxial alignment with the center aperture 38.

Figure 5:
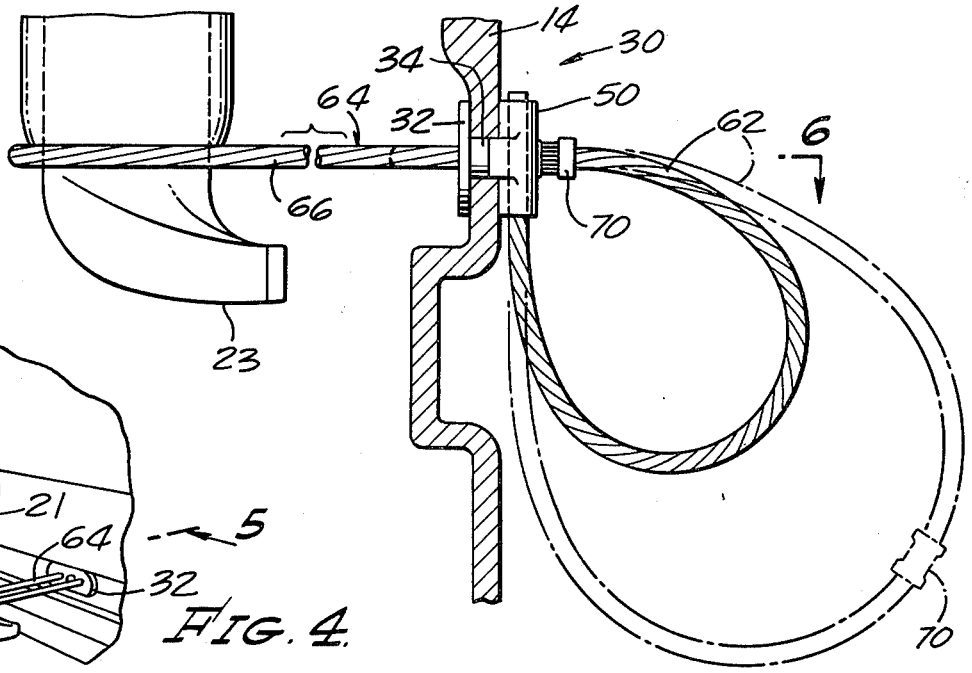
FIG. 5 is a sectional side elevation taken substantially along line 5—5 as shown in FIG. 4.
Figure 6:
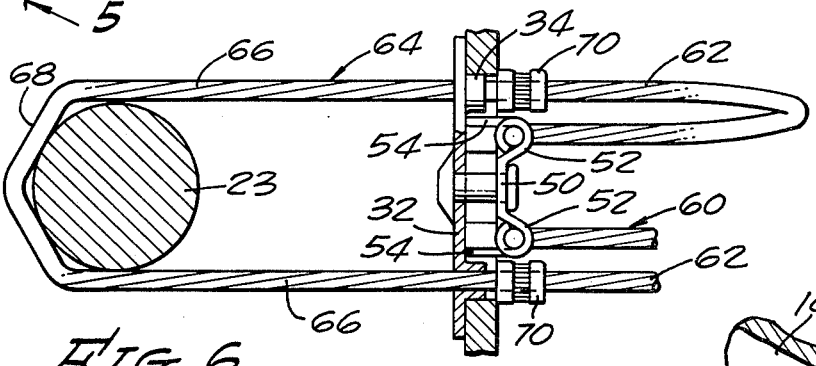
FIG. 6 is a sectional plan view taken substantially along line 6—6 as shown in FIG. 5.
Figure 7:
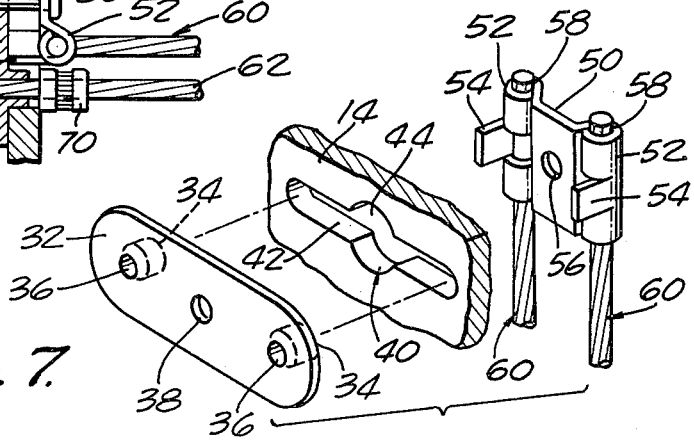
FIG. 7 in an exploded view of the parts of the door holdback device.

Opposite the first bracket 32 is a second bracket 50 having opposing roll sections 52, said roll sections 52 having flanges 54 adapted to fit securely within the lateral sections 42 of the slot 40. Centrally disposed within the second bracket 50 is a bracket aperture 56 which in the assembled configuration is coaxial with the center section 44 and the center aperture 38. The roll sections 52 create mounting cavities 58 through which a cable 60 passes and is secured therein. As shown in FIGS. 5 and 6, the cable 60 passes through the apertures 36 found within the posts 34 thus forming a primary loop 64. The primary loop 64 has opposing side sections 66 and a preformed front section 68. The cable 60 by being attached to the second bracket 50 at the roll sections 52, and then passing through the apertures 36, also forms two secondary loops 62 on the opposite side of the sidewall 14 from the primary loop 64. Stop members 70 are mounted upon the secondary loops 62 along their circumference.

Figure 4:
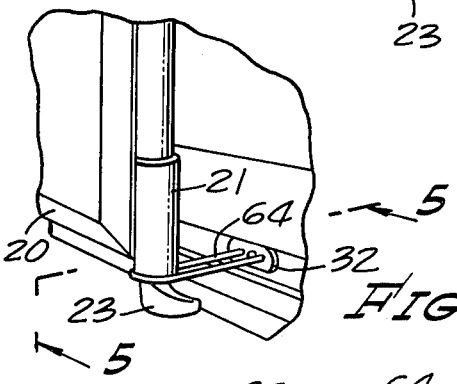
FIG. 4 is a fragmentary perspective view of the door holdback device of the present invention in an operative position.

Referring to FIG. 4, in operation the side sections 66 of the primary loop 64 are in substantially perpendicular alignment with the sidewall 14 and the first bracket 32. The primary loop 64 is formed by pulling upon the preformed section 68 and placing said preformed section over the locking rod 23 thus securing the door 20 in a open position. The stop members 70 abut against the interior side of the sidewall 14, thus restricting the size of the primary loop 64 as well as limiting the flexing stress formed within the secondary loops 62. The secondary loops 62 as shown in FIG. 5 become reduced in size due to the extension of the primary loop 64. Upon removing the preformed section 68 from the locking rod 23 an unwinding stress within the secondary loops 62 causes the primary loop 64 to retract, thus increasing the size of the secondary loops 62 and causing the preformed section 68 to obtain a more proximate relationship with the sidewall 14. This proximate relationship is necessary as the boxlike trailer too often is exposed to enclosed environmental conditions. It will be observed that very little structural damage is done to the sidewall 14 due to the mounting of the first bracket 32 and second bracket 50 thereon. A bolt 46 passes through the center aperture 38, the center section 44 and the bracket aperture 56, said bolt 46 securing the first bracket 32 and second bracket 50 to the sidewall 14. It is to be noted that the door holdback device 30 may also be mounted on a door 20 with the primary loop 64 engageable with an arm 29 mounted upon the sidewall 14.

Figure 8:
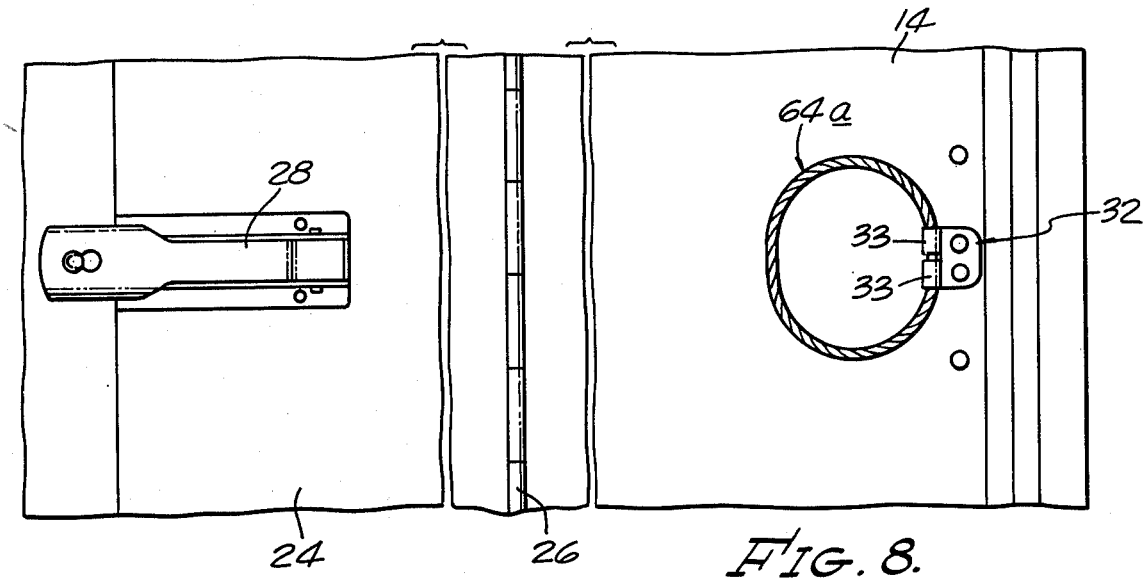
FIG. 8 is a side elevation showing a second embodiment of the door holdback device shown in inoperative retracted position.
Figure 9:
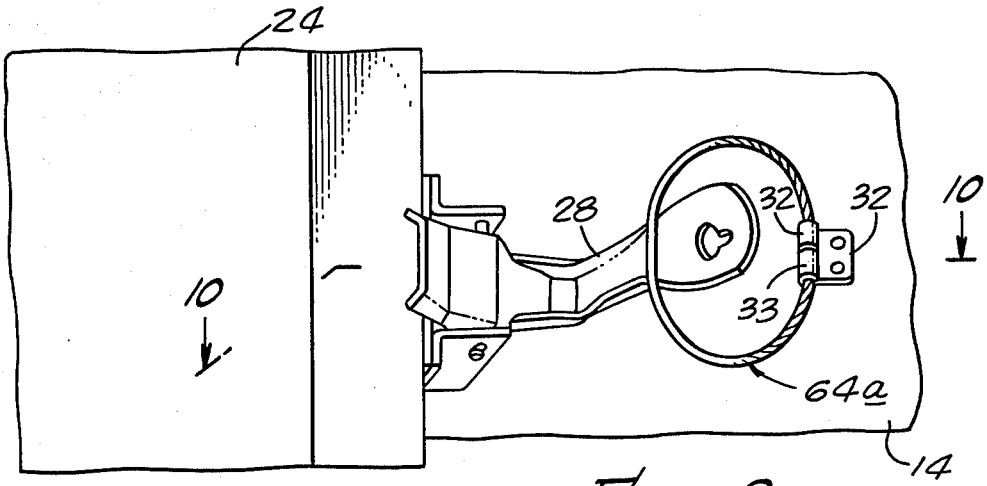
FIG. 9 is a view similar to FIG. 8 showing the door holdback device in operative position.
Figure 10:
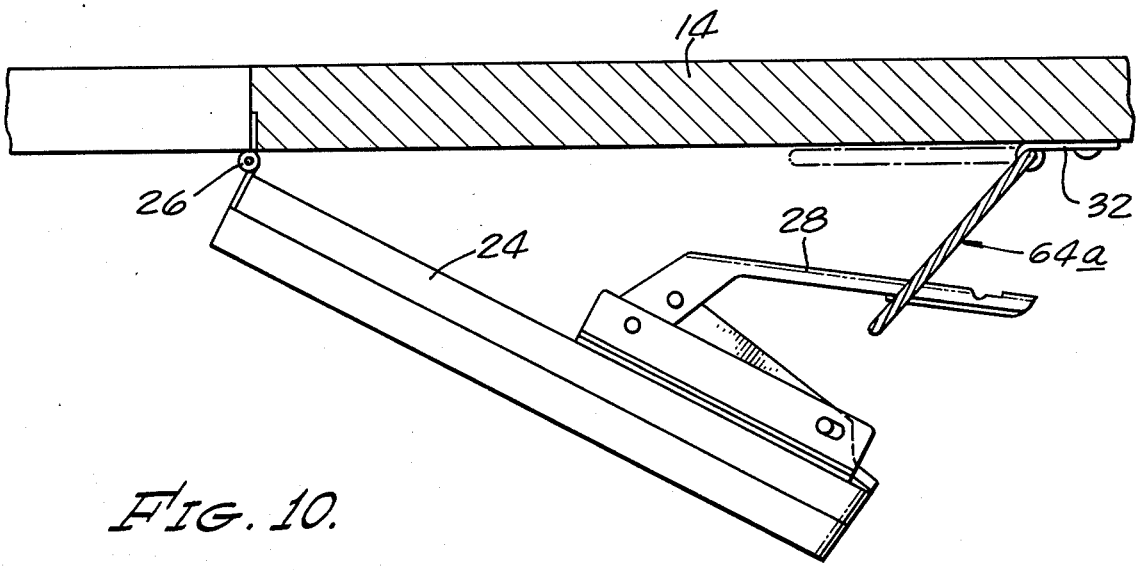
FIG. 10 is a sectional plan view taken substantially along line 10—10 as shown in FIG. 9.

Referring to FIGS. 8 and 9, in a second embodiment of the present invention a primary loop **64*a* extends from a bracket 32*a* which is mounted to the sidewall 14 on its external surface. The primary loop 64*a* is partially encased by mounts 33*a* in such a manner that a twisting or flexing stress is applied to the primary loop 64*a*. The twisting stress within the primary loop 64*a* causes said primary loop 64*a* to maintain a coplanar relationship with the sidewall 14 when in an inoperative position, as shown by the phantom lines in FIG. 10. By moving the primary loop 64*a* away from the sidewall 14 it is adapted to engage a latch handle 28 found upon a panel 24. The primary loop 64*a* is adapted to fit upon various size handles 28 which may be found upon the vent panels 24. The prestressed condition of the primary loop 64*a* causes it to pass into an inoperative state coplanar with the sidewall 14**, thus reducing the possibility of damage by external contact.

Having fully described our invention, it is to be understood that we are not to be limited to the details herein set forth but that our invention is of the full scope of the appended claims.

We claim:

1. In a holdback device for holding a door or panel in open position with respect to a wall of a highway vehicle or the like, the improvement comprising, in combination: a bracket for attachment to the wall, a flexible loop, means for attaching said flexible loop to said bracket to create an internal flexing stress in said loop, whereby in a first position said loop extends from said wall to engage an element on said door or panel, and in a second position said loop retracts into closer proximity with the wall solely caused by internal flexing stress existent within said loop.

2. In a holdback device for holding a door member in open position with respect to a wall member of a highway vehicle or the like, the improvement comprising, in combination: a bracket, means for attaching the bracket to one of the members, a flexible loop, means for attaching said flexible loop to said bracket to create an internal flexing stress in said loop, whereby in a first position the loop extends from the member to which it is attached to engage an element on the other member, and in a second position the loop retracts into closer proximity with the member to which it is attached solely caused by internal flexing stresses in said loop.

3. In a holdback device for holding a door or panel in open position with respect to a wall of a highway vehicle or the like, the improvement comprising, in combination: a bracket for attachment to the wall and having a pair of apertures therein, a flexible cable passing through said apertures to define a primary loop on one side of said bracket, said cable having substantially parallel secondary loops positioned on the other side of said bracket, whereby pulling of the primary loop is resisted by internal stresses in the cable caused by reduction in size of said secondary loops.

4. The combination set forth in claim 3 in which stop members are clamped to the secondary loops to limit movement of the primary loop in a direction to increase its length.

5. In a holdback device, for holding a door or panel in open position with respect to a wall of a highway trailer or the like, the improvement comprising, in combination: an apertured wall section having interior and exterior sides;

a flexible cable passing through said apertured wall section forming a primary loop extending from said exterior side of said apertured wall section, a pair of substantially parallel positioned secondary loops formed from said cable, said secondary loops being integral with said primary loop, a means for attaching said secondary loops to said interior side of apertured wall section, whereby an unwinding stress is created within said secondary loops to retract the primary loop.

6. The door holdback device of claim 5, in which stop members are clamped upon said secondary loops to limit movement of the primary loop away from said apertured wall section.

7. The door holdback device of claim 5, in which said primary loop has a preformed portion.

8. The door holdback device of claim 5, in which an apertured first bracket substantially parallel with said wall section, is attached to said exterior side of said wall section, said cable passing through said apertured first bracket.

9. The door holdback device of claim 8, in which a second bracket is attached to said interior side of said apertured wall section, wherein said secondary loops are attached to said second bracket.

10. The door holdback device of claim 9, in which a means for interconnecting said first bracket to said second bracket is provided.

11. In a holdback device for holding a door member or a panel member in open position with respect to a wall member of a highway vehicle or the like, the improvement comprising, in combination: a bracket, means for attaching the bracket to one of the members, a flexible endless loop, means for attaching a portion of said flexible endless loop to said bracket to create an internal flexing stress in said loop, whereby in a first position the loop extends from the member to which it is attached to engage an element on the other member, and in a second position the loop retracts into closer proximity with the member to which it is attached solely caused by internal flexing stresses in said loop.

* * * * *